US006145501A

United States Patent [19]

Manohar et al.

[11] Patent Number: 6,145,501

[45] Date of Patent: Nov. 14, 2000

[54] LOW EMISSION COMBUSTION SYSTEM

[75] Inventors: Shailesh Sharad Manohar, Liverpool; Brian D. Videto, Syracuse; Chi Ming Ho, Manlius, all of N.Y.

[73] Assignee: Carrier Corporation, Syracuse, N.Y.

[21] Appl. No.: 09/435,478

[22] Filed: Nov. 8, 1999

[51] Int. Cl.[7] ..... F24H 3/02

[52] U.S. Cl. ..... 126/110 R; 126/91 A; 431/326; 431/328; 431/170

[58] Field of Search ..... 431/7, 326, 328, 431/170, 354, 327, 329; 126/91 A, 110 R

[56] References Cited

U.S. PATENT DOCUMENTS 4,776,320 10/1988 Ripka et al. .
5,108,284 4/1992 Gruswitz .
5,244,381 9/1993 Cahlik .
5,333,597 8/1994 Kirkpatrick et al. .
5,370,529 12/1994 Lu et al. .
5,453,003 9/1995 Pfefferle ..... 431/7
5,511,972 4/1996 Dalla Betta et al. ..... 431/7
5,624,252 4/1997 Charles, Sr. et al. ..... 431/328
5,746,194 5/1998 Legutko .
5,791,893 8/1998 Charles, Sr. et al. ..... 431/328
5,848,887 12/1998 Zabielski et al. .

*Primary Examiner*—James C. Yeung
*Attorney, Agent, or Firm*—William W. Habelt

[57] ABSTRACT

A burner system for a furnace (10) includes an in-shot burner (20) having an axially elongated tubular nozzle (40) having an inlet end (42), an outlet end (44) and a venturi transition section (46) therebetween. At least a portion of a catalyst body (50) is disposed within the outlet end (44) of the burner (40). The catalyst body (50) supports a partial oxidization catalyst operative to catalyze the fuel in the primary air/fuel mixture to intermediate combustion species, including hydrogen and carbon monoxide, thereby reducing emissions such as nitrogen oxides.

10 Claims, 5 Drawing Sheets

LOW EMISSION COMBUSTION SYSTEM

TECHNICAL FIELD

The present invention relates generally to gas fired combustion apparatus such as residential and light commercial furnaces and the like. More particularly, the present invention relates to a combustion system for use in such a gas fired apparatus characterized by a reduced level of emission of oxides of nitrogen ($NO_x$).

BACKGROUND OF THE INVENTION

During the combustion of fossil fuels, including gaseous fuels such as natural gas, liquefied natural gas and propane, for example, in air, $NO_x$ is formed and emitted to the atmosphere in the combustion products. With respect to gaseous fuels that contain little or no fuel-bound nitrogen per se, $NO_x$ is formed as a consequence of oxygen and nitrogen in the air reacting at the high temperatures resulting from the combustion of the fuel.

Governmental agencies have passed legislation regulating the amount of oxides of nitrogen that may be admitted to the atmosphere during the operation of various combustion devices. For example, in certain areas of the United States, regulations limit the permissible emission of $NO_x$ from residential furnaces and water heaters to 40 ng/J (nanograms/Joule) of useful heat generated by these combustion devices. It is expected that future regulations will restrict $NO_x$ emissions from residential furnaces, water heaters and boilers to even lower levels.

Gas fired apparatus, such as residential and light commercial heating furnaces, often use a particular type of gas burner commonly referred to as an in-shot burner. An in-shot burner comprises a burner nozzle having an inlet at one end for receiving separate fuel and primary air streams and an outlet at the other end through which mixed fuel and primary air discharges from the burner nozzle in a generally downstream direction. The burner nozzle may comprise simply comprise an axially elongated, straight tube, or it may comprise a generally tubular member, which may be arcuate or straight, having an inlet section, an outlet section and a transition section, commonly a venturi section, disposed therebetween. Fuel gas under pressure passes through a central port disposed at or somewhat upstream of a fuel inlet to the inlet of the burner nozzle. The diameter of the inlet to the burner nozzle is larger than the diameter of the fuel inlet so as to form an annular area through which atmospheric air is drawn into the burner nozzle about the incoming fuel gas. This primary air mixes with the fuel gas as it passes through the tubular section of the burner nozzle to form a primary air/gas mix. This primary air/gas mix discharges from the burner nozzle through the outlet of the burner nozzle and ignites as it exits the nozzle outlet section forming a flame projecting downstream from a flame front located adjacent or somewhat downstream of the outlet of the burner nozzle. Secondary air flows around the outside of the burner nozzle and is entrained in the burning mixture downstream of the nozzle in order to provide additional air to support combustion.

In conventional practice, a flame retention device is often inserted within the outlet section of the burner in an attempt to achieve improved flame stability and reduction of noise. One known insert comprises a cylindrical body defining a central opening and having a toothed perimeter formed by a plurality of circumferentially spaced, axially elongated splines extending radially outwardly in a sunburst pattern about the circumference of the cylindrical body. U.S. Pat. No. 5,108,284, Gruswitz, for example, discloses an in-shot burner having a sunburst type flame retention device wherein each spline comprises an axially elongated bar of rectangular cross-section. U.S. Pat. No. 5,791,893, Charles, Sr. et al., discloses an in-shot burner having a porous silicon carbide ceramic flame retention insert located in the outlet section of the burner nozzle. Another known insert has a central opening surrounded by a series of circumferentially spaced, small holes.

U.S. Pat. No. 4,776,320, Ripka et al., discloses a gas-fired furnace utilizing an in-shot burner wherein a thermal energy radiator structure, such as a perforated stainless steel tube, is disposed in the flame downstream of the burner outlet. The radiator structure tempers the flame by absorbing heat therefrom and radiating the absorbed heat to the surrounding heat transfer surface, whereby peak flame temperatures are limited and residence times at peak flame temperature are reduced.

U.S. Pat. No. 5,333,597, Kirkpatrick et al., discloses a gas-fired furnace utilizing an in-shot burner wherein a porous $NO_x$ abatement member is disposed in the flame downstream of the burner outlet. The combustion flame and combustion products pass through the porous $NO_x$ abatement member, whereby peak combustion temperatures and residence times at peak temperatures are reduced. The preferred $NO_x$ abatement member is stated to be a metallic screen since metals are good thermal conductors and radiators, although ceramic refractory materials are also stated to be acceptable.

U.S. Pat. No. 5,370,529, Lu et al., discloses a gas-fired furnace wherein a mesh tube is disposed in the flame downstream of the burner outlet. During operation of the burner, the flame passes through the mesh tube, thus reducing the cross-section of the flame, increasing the axial velocity of the flame, and substantially diminishing contact of the secondary combustion air with the maximum temperature zones of the flame, whereby $NO_x$ formation is said to be inhibited.

U.S. Pat. No. 5,244,381, Cahlik discloses a gas-fired furnace utilizing an in-shot burner wherein a flame spreader, which in the depicted embodiment comprises a stainless steel plate having a plurality of stainless steel rods mounted on its face, is disposed in the flame downstream of the burner outlet. The flame spreader is said to absorb flame heat energy and lower the temperature of the flame, so as to reduce $NO_x$ formation in the flame.

A problem associated with the reduction of nitrogen oxide formation by lowering the flame temperature is that as the flame is quenched, combustion efficiency is reduced and combustion may not be totally completed. As a consequence of flame quenching, carbon monoxide formation will increase as nitrogen oxide formation decreases.

U.S. Pat. No. 5,174,744, Singh, discloses an industrial gas-fired burner wherein a block of highly porous reticulated ceramic foam is disposed in spaced relationship to and downstream of the burner nozzle. The burner is operated so as to produce a low temperature flame resulting in lower $NO_x$ emissions but also increased carbon monoxide emissions. The incompletely combusted carbon monoxide passes through the ceramic foam block and is said to be oxidized into carbon dioxide by oxygen in the surrounding air as it traverses the hot foam block.

U.S. Pat. No. 5,848,887, Zabielski et al., discloses a low emission combustion system for a residential heating furnace including both a radiator body and a catalyst. The radiator body is disposed in the flame downstream of an in-shot burner to quench the flame to reduce $NO_x$ formation, while the catalyst is disposed further downstream of the flame in a lower temperature region for oxidizing carbon monoxide in the flue gas to carbon dioxide.

To avoid the consequence of increased carbon monoxide formation associated with reduction of $NO_x$ emissions by reducing peak flame temperatures, attempts have been made to reduce nitrogen oxides formation by using a catalyst to promote chemical reactions which result in a reduction of $NO_x$ formation in the flame. U.S. Pat. No. 5,746,194, Legutko, discloses a combustion system having an in-shot burner wherein a flow dividing member supports a partial oxidation catalyst disposed in the fuel rich inner core of the flame downstream of the burner outlet. The catalyst serves to catalyze unburnt methane in the fuel rich inner core of the flame to hydrogen and carbon monoxide. When this hydrogen and carbon monoxide subsequently combust in the air rich outer zone of the flame, the peak combustion temperatures are lower than in conventional combustion and $NO_x$ formation is reduced. The catalytic insert is heated above the reaction "light-off" temperature of the catalyst directly by the flame itself. The catalytic insert also radiates heat away from the flame to further reduce peak temperature within the flame.

SUMMARY OF THE INVENTION

It is an object of this invention to reduce the formation of nitrogen oxides during combustion of fuel in a combustion system.

It is another object of this invention to provide a combustion system having an improved in-shot gas burner nozzle characterized by reduced nitrogen oxides formation.

The combustion system of the present invention includes an in-shot burner having a burner tube having an inlet end, an outlet end and a transition section therebetween, which may be arcuate or straight, as desired. A catalytic insert is supported within the outlet end of the burner tube. The catalytic insert includes a partial oxidization catalyst operative to catalyze at least a portion of the methane in the fuel gas and primary air mixture to intermediate combustion species, including for example hydrogen and carbon monoxide, prior to the fuel and primary air mixture exiting the burner outlet. As a consequence of the partial oxidization of the fuel gas, peak temperatures in the flame are reduced resulting in a correspondent reduction in nitrogen oxide formation in the flame.

DESCRIPTION OF THE DRAWINGS

Further understanding of the present invention, reference should be made to the following detailed description of a preferred embodiment of the invention taken in conjunction with the accompanying drawings wherein.

DESCRIPTION OF THE PREFERRED EMBODIMENT

Figure 1:
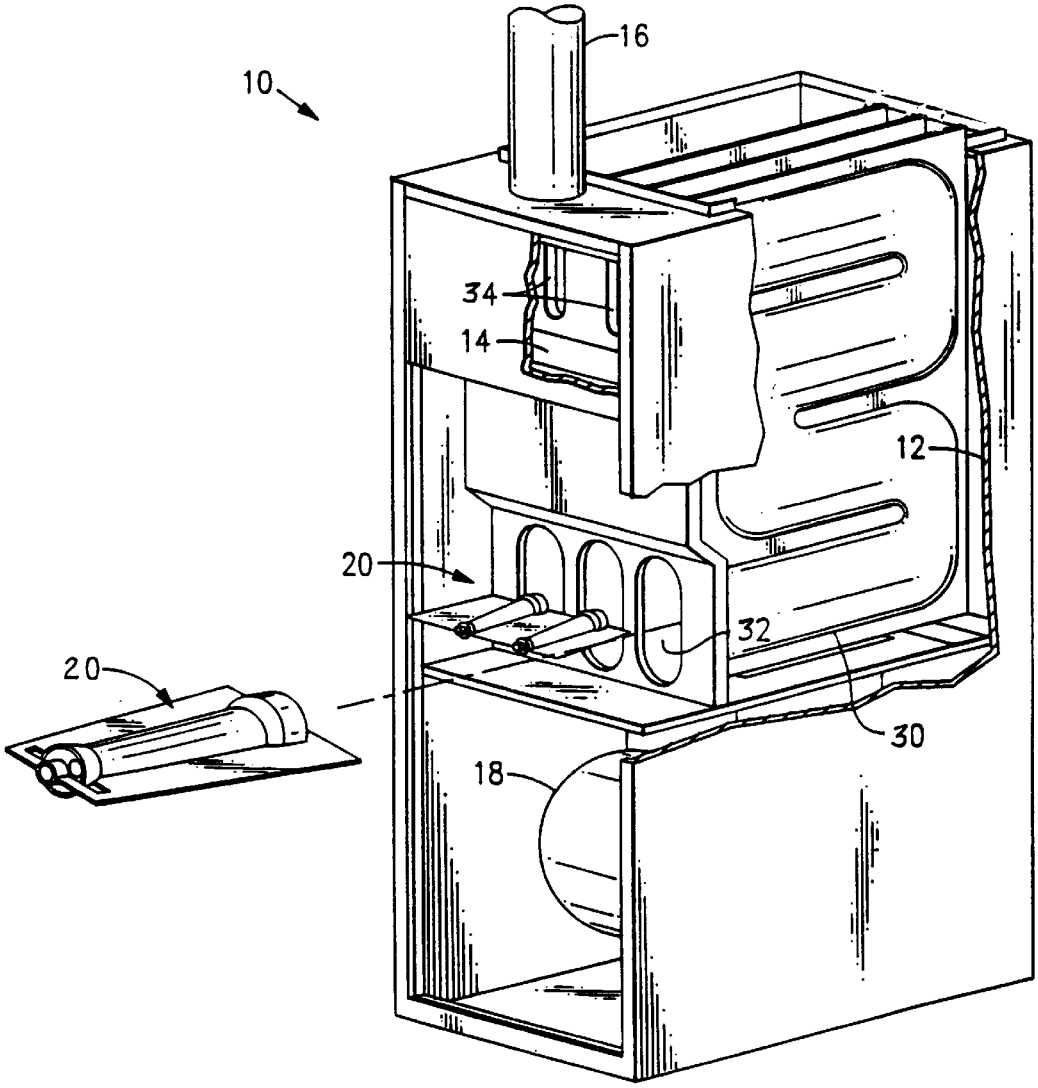
FIG. 1 is a partially exploded and partly broken away isometric view of a gas-fired furnace equipped with a combustion system having in-shot burners.

For purposes of illustration, the combustion system of the present invention is depicted in the drawings as embodied in a gas-fired residential heating furnace equipped with an in-shot burner. It is to be understood, however, that the principles of the present invention are applicable to other types of burners and fuel-fired appliances.

Figure 2:
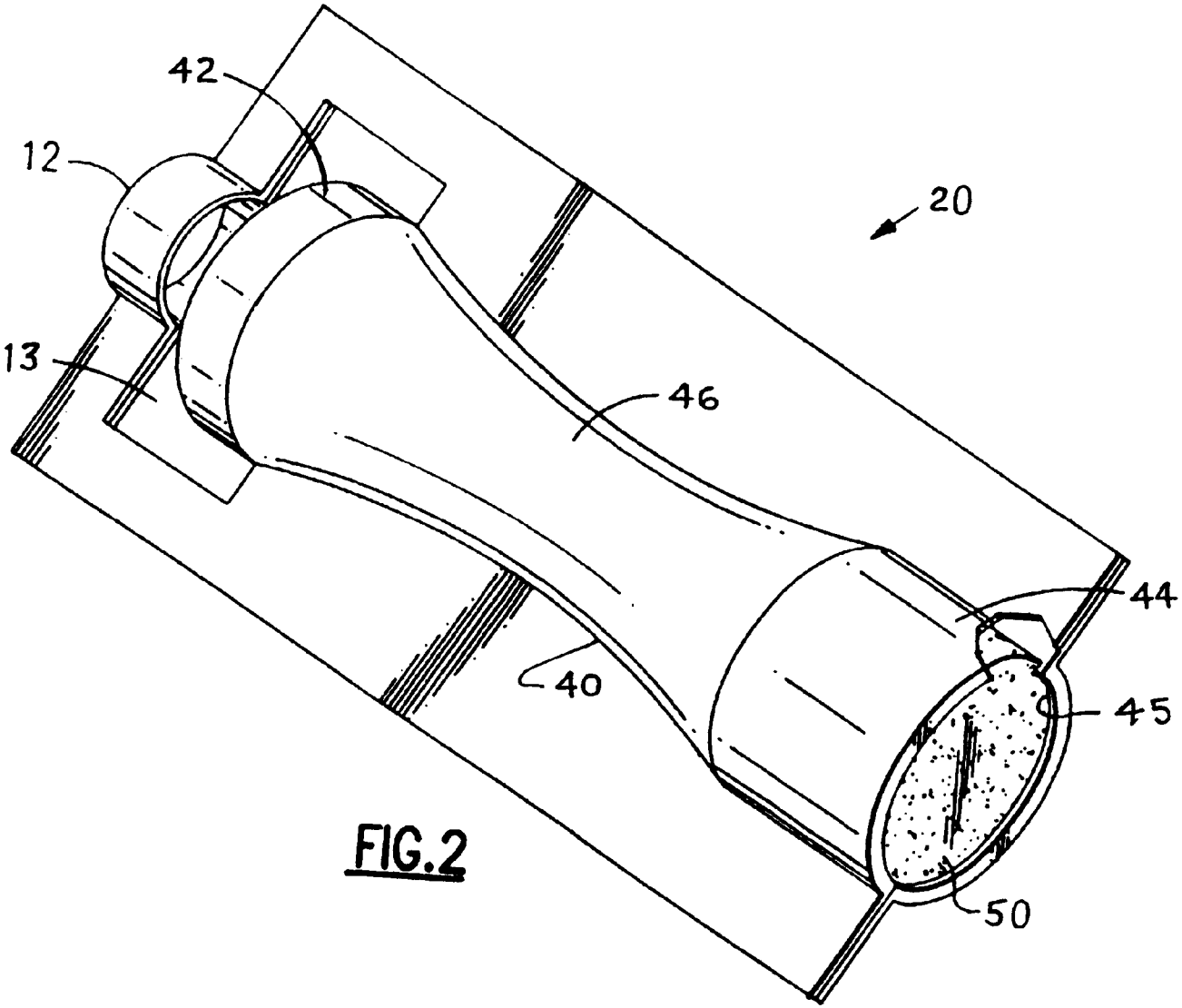
FIG. 2 is a pictorial view of a combustion system comprising an in-shot burner including a catalytic insert in accordance with the present invention.

Referring now to FIGS. 1 and 2, the gas-fired residential heating furnace 10 is equipped with a plurality of gaseous fuel burners 20, that are of the general type commonly referred to as an in-shot burner, and a corresponding plurality of heat transfer tubes 30. In the depicted embodiment, each burner 20 comprises a burner tube 40, commonly referred to as a burner nozzle, having an inlet end 42, an outlet end 44 and an axially elongated transition section 46 extending therebetween. As depicted in the drawing, the transition section 46 may constitute a venturi. A fuel gas port 12, spaced upstream of and coaxial with the inlet end 42 of the nozzle 40, is provided for communication to a fuel gas supply line, not shown. The inlet end 42, which may preferably be flared outwardly in the upstream direction, has a larger diameter inlet opening than the fuel gas inlet opening defined by the fuel gas port 12, thereby defining an annular region therebetween. In operation, primary combustion air is aspirated or pumped through the annular region into the nozzle 40 as the pressurized fuel gas from the supply line, not shown, passes through the fuel gas port 12 into the nozzle 40. Secondary combustion air passes around the outside of the nozzle 40 and gradually mixes into the flame extending axially downstream from the outlet of the burner 20.

The burners 20 and heat transfer tubes 30 are arranged in a conventional manner such that, in operation, the flames passing out of the outlet ends 44 of the respective burners 20 enter a respective heat transfer tube 30 through an inlet 32 to the tube 30, which is disposed in opposed relationship to the outlet end 44 of a respective burner as illustrated in FIG. 1. The hot combustion products generated in the flames pass through the gas flow conduits formed by the respective heat transfer tubes 30 and a tube outlet 34 to a common flue gas outlet plenum 14 from which the combustion products vent to the atmosphere through flue pipe 16. Further, a fan 18 is provided in the furnace for drawing air to be heated through an air inlet (not shown) and through the open spaces between the laterally spaced, parallel heat transfer tubes 30 so as to flow over the exterior of the heat transfer tubes. As the air passes over the heat transfer tubes, the air is heated by heat conducted through the walls of the heat transfer tubes from the hot combustion products. The heated air passes out of the furnace housing into the building air ducts for distribution to the space to be heated.

Each of the heat transfer tubes 30, depicted in the drawing as being of the clamshell plate type formed by assembling two mating plates, typically metallic, defines within its interior a serpentine gas flow conduit. It is to be understood, however, that the particular configuration or shape of the gas flow conduit and construction of the heat transfer tube 30 may vary from that depicted herein without departing from the principles of the present invention. As noted previously, each heat transfer tube 30 is disposed with its inlet 32 in opposed facing relationship to the outlet end 44 of a respective burner nozzle 40. The flame discharging axially outwardly from the outlet end 44 of each burner nozzle 40 passes through the tube inlet 32 into the gas flow conduit defined by a respective heat transfer tube 30.

Figure 3:
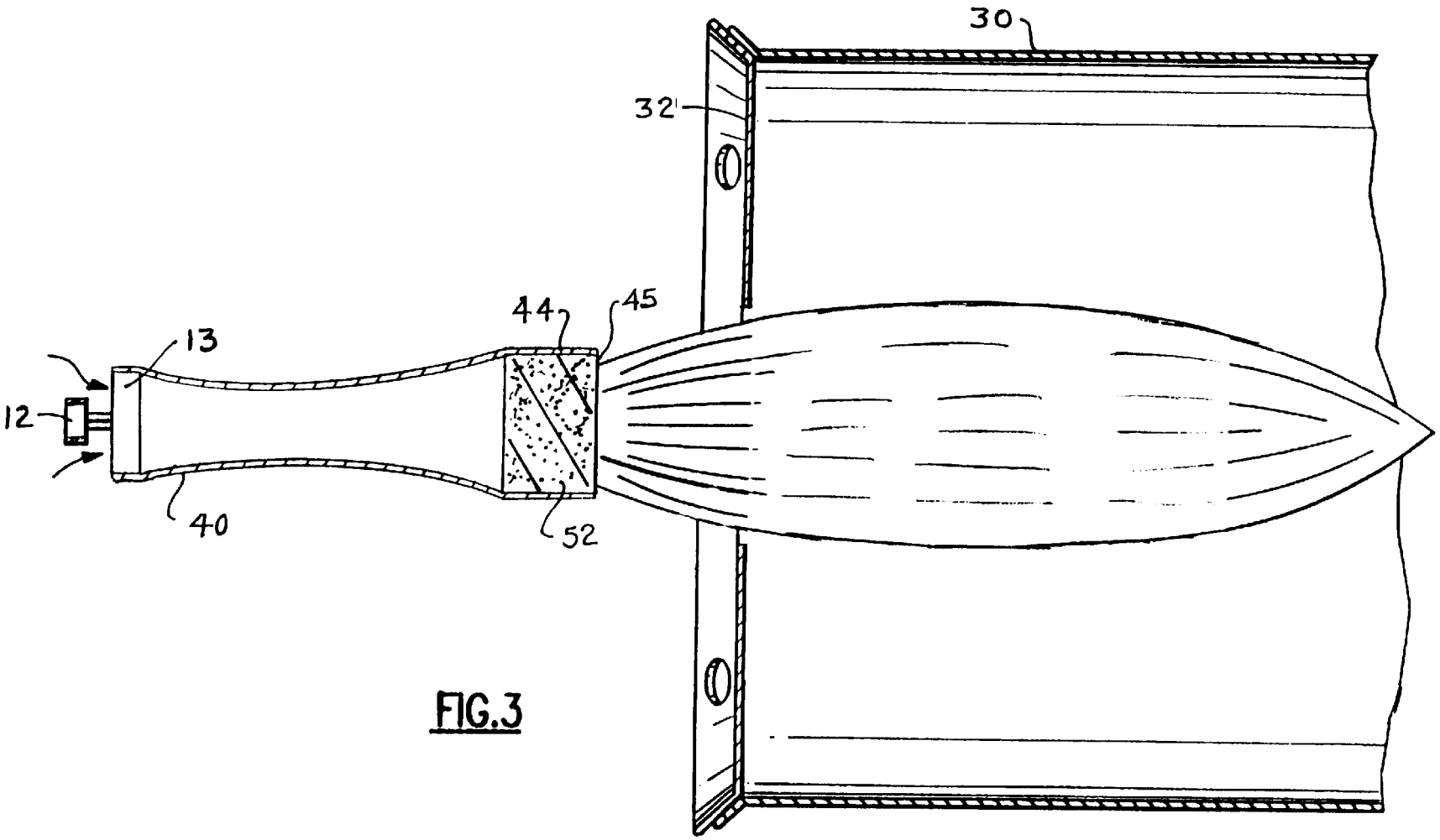
FIG. 3 is a sectional, side elevation of a single burner and associated heat transfer tube of the furnace of FIG. 1.

Referring now to FIGS. 2 and 3, in accordance with the present invention, a catalytic insert 50 is supported within the outlet end 44 of the burner tube 40. The catalytic insert 50 includes a partial oxidization catalyst operative to catalyze at least a portion of the methane in the fuel gas and primary air mixture to intermediate combustion species, including hydrogen and carbon monoxide, prior to the fuel and primary air mixture exiting the burner outlet 44. As a consequence of the partial oxidization of the fuel gas, peak temperatures in the flame are reduced resulting in a correspondent reduction in nitrogen oxide formation in the flame.

The catalytic insert 50 may comprise a ceramic or metallic body 52 supporting, or itself comprising, a partial oxidization catalyst. The body 52 must have flow paths therethrough to allow the primary air/gas mixture to pass through the ceramic body without excessive pressure drop and to contact the oxidization catalyst dispersed within the matrix of the porous ceramic body. For example, the body 52 may comprise a porous ceramic body having the oxidation catalyst dispersed throughout its porous matrix. In such case, the porosity of the ceramic body must be sufficient to allow the primary air/gas mixture to pass through the ceramic body and to contact the oxidization catalyst dispersed within the matrix of the porous ceramic body. Alternatively, the catalytic insert may comprise a substantially non-porous body, ceramic or metallic, having a plurality of flow passages, such as for example channels or bores, extending generally axially therethrough. In such a case, the surfaces of the bores would be coated or impregnated with the oxidation catalyst such that the primary air/gas mixture passing through the bores would contact the catalyst.

If formed of ceramic, the body 52 may be composed of silicon carbide, silicon carbide with alumina and/or silica, or other conventional ceramic materials suitable for use as a burner insert. The oxidization catalyst supported by the body 52 may comprise any material capable of catalyzing the oxidation of the fuel gas to intermediate combustion species, including for example hydrogen and carbon monoxide, such as for example: transition metal oxides such as those of chromium, manganese, or vanadium; noble metals such as platinun, palladium, rhodium or iridium; or materials such as magnesium oxide and nickel. In the case of the latter materials, the body 52 may be formed entirely from the catalyst material itself, if desired.

In operation, the primary air/fuel mixture passing through the burner nozzle 40 contacts the catalyst material as it passes through the catalytic insert 50. In passing through the catalytic insert 50, at least a portion of the fuel in the primary air and fuel mixture oxidizes due to a catalytic reaction into intermediate species, including for example carbon monoxide and hydrogen. In accordance with the present invention, at least a substantial portion of the catalytically active section of the catalyst insert 50, i.e. the catalyst body 52, is disposed within the outlet section 44 of the burner nozzle 40 whereby the fuel in the primary air/fuel mixture contacts the catalyst prior to actual flame formation, that is upstream of the flame front. As the catalytic insert 50 also serves as a flame retainer insert, the flame front is typically established at the surface of the downstream end of the catalytic insert 50 where the primary air and fuel mixture passes out of the catalytic insert 50 and the outlet 45 of the burner nozzle 40 to mix with the secondary air flow passing around the outside of the burner nozzle. By disposing at least a substantial portion of the catalytically active catalyst body 52 within the outlet section 44 of the burner nozzle 40 upstream of the flame front, the catalyst material within the catalyst body 52 is maintained at a temperature significantly below peak flame temperatures, whereby the active life of the catalyst material is prolonged.

In the embodiment of the present invention depicted in FIGS. 2 and 3, the catalyst body 52 is inserted in its entirety within the outlet section 44 of the burner nozzle 40. In this arrangement, the catalyst body 52 is preheated by heat from the flame front formed on the end surface 54 of the catalyst body to a temperature above the activation temperature of the catalytic material in the catalyst body 52, typically on the order of 600 F (315 C). Alternatively, an external heat source, for example an electric heater, may be used to heat the catalyst body 52 to the desired temperature.

Figure 4:
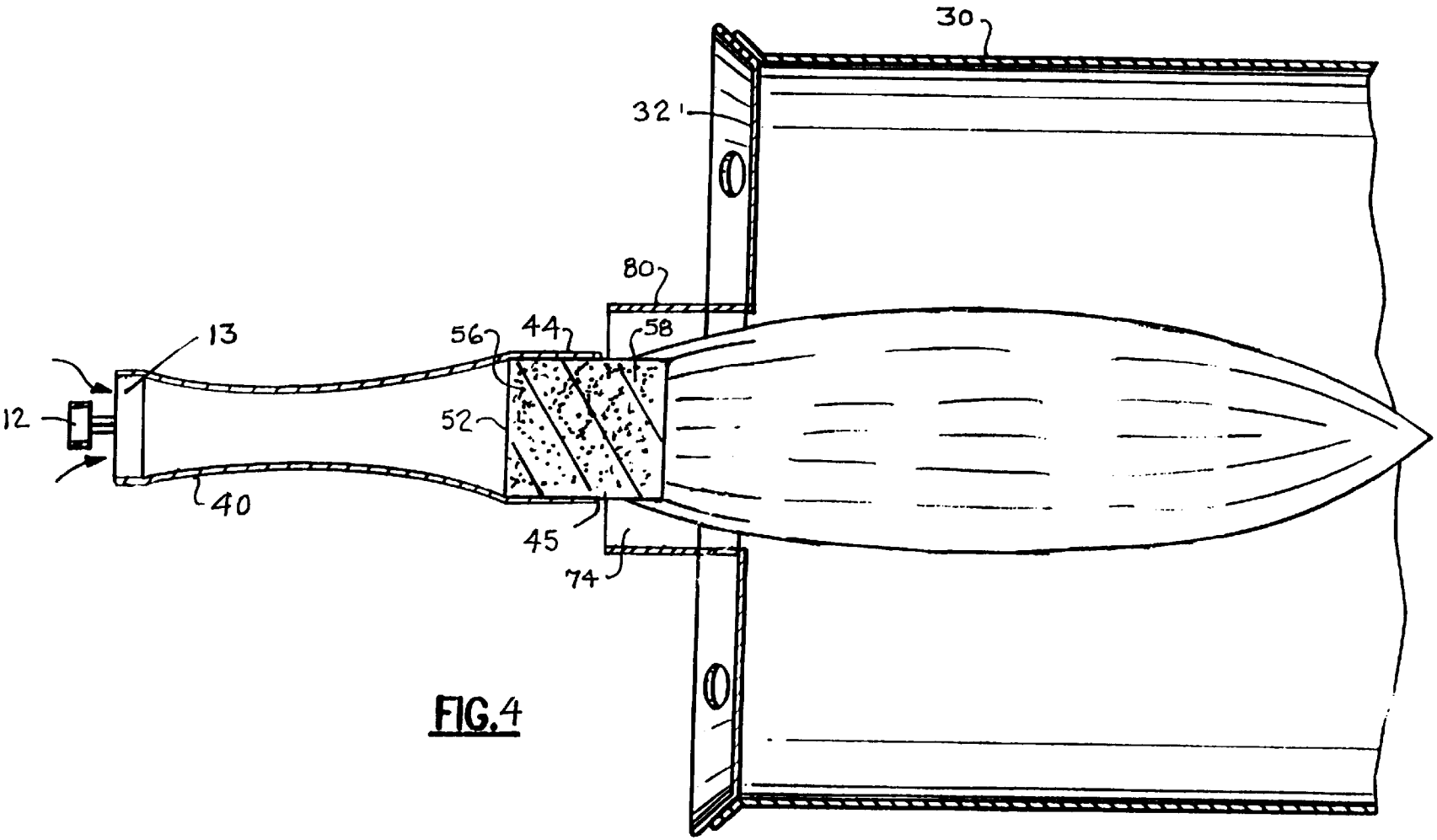
FIG. 4 is a sectional, side elevation view of another embodiment of the combustion system of the present invention.

In the embodiment of the present invention depicted in FIG. 4, the catalyst body 52 has a first portion 56 disposed within the outlet section 44 of the burner nozzle 40 and a second portion 58 extending from the outlet end 45 of the burner nozzle 40 to the distal end of the catalyst body 52 disposed downstream of the burner nozzle. In this arrangement the second portion 58 of the catalyst body 52 is heated by the flame and the first portion 56 of the catalyst body 52 is in turned preheated to the activation temperature of the catalyst material by conduction from the second portion 58 of catalyst body 52. In one particular embodiment of this arrangement, the catalyst material is concentrated substantially within the first portion 56 of the catalyst body 52, while the second portion 58 of the catalyst body 52 is essentially non-reactive, that is void of catalyst material. If desired, however, the catalyst material may be relatively uniformly distributed over both portions 56 and 58 of the catalyst body 52, or otherwise distributed in any desired proportion between the portions 56 and 58.

Figure 5:
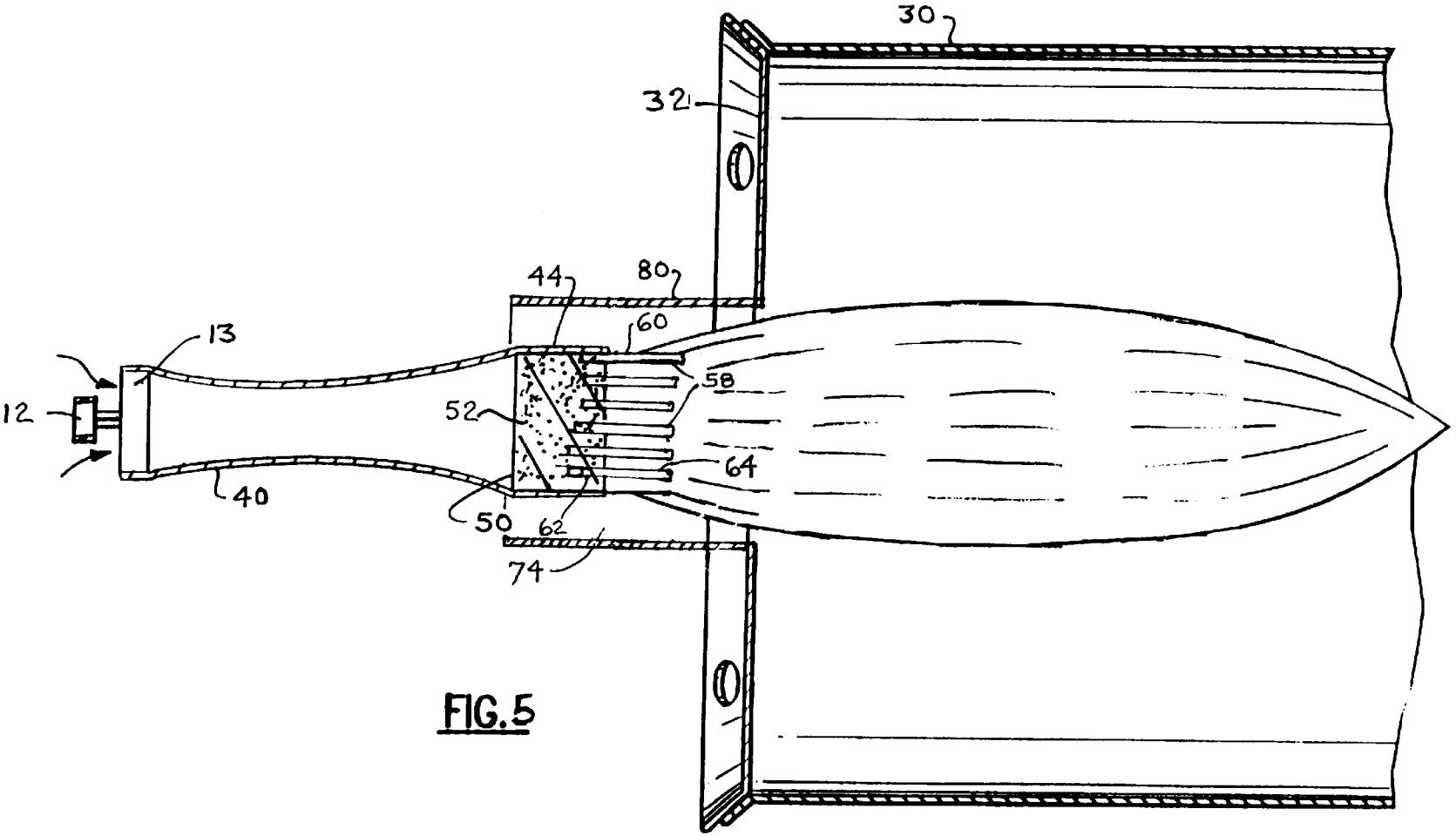
FIG. 5 is a sectional, side elevation view of another embodiment of the combustion system of the present invention.

In a further embodiment of the present invention depicted in FIG. 5, the catalytic insert 50 comprises a first catalytically active catalyst body 52 disposed within the outlet section 44 of the burner nozzle 40 and a second heat transfer portion 58 extending in a downstream direction from the downstream end of the catalyst body 52 into the flame region formed downstream of the burner outlet 45. In the depicted embodiment, the second heat transfer portion comprises a plurality of spaced, axially extending rods 60 of heat conductive material. The proximate end 62 of each rod 60 is disposed within the catalyst body 52 while the distal end 64 of each rod 60 extends into the flame region downstream of the burner outlet 45. The distal ends 64 of the rods 60 are heated by the flame and that heat passes by conduction back along the respective rods to their proximate ends whereby the catalyst body 52 is preheated to the activation temperature of the catalyst material.

As a result of heat transfer from the flame to the catalyst body 52 and also as a result of the catalyzed partial oxidization reactions occurring within the catalyst body 52, the temperature of the catalyst body 52 increases. To minimize the loss of heat from the catalyst body 52 through the wall of the outlet section 44 of the burner nozzle 40, it is advantageous to place a layer of insulation between the outer surface of the catalyst body 52 and the wall of the surrounding outer section 44 of the burner nozzle 40. Further, the overall efficiency of the burner system may be reduced if heat radiated from the extending portion of the catalytic insert 50 is lost from the system. Accordingly, it is advantageous to provide a shroud 80 at least partially about the burners 20 and the region between the burners 20 and the inlet to the heat transfer tubes 30. With the shroud in place, heat loss from the catalytic insert 50 will be absorbed by the secondary air passing about the outer surface of the burners 20 and through the region 74 before mixing with the flame and passing into the heat transfer tubes 30. The presence of such a shroud is particularly advantageous in embodiments of the present invention having a portion of the catalytic insert 50 extending axially beyond the outlet 45 of the burner nozzle 40, such as the embodiments depicted in FIGS. 4 and 5. The shroud 80 extends about its respective associated burner 20 sufficiently in an axial direction as to enshroud that at least a portion of the section of the burner housing the catalytic insert 50, and most advantageously all of the section of the burner housing the catalytic insert 50.

A prototype in-shot burner incorporating a catalyst insert in accordance with the present invention was tested with natural gas fuel to compare $NO_x$ formation with that of a conventional residential in-shot burner. For all test cases, natural gas was used with a #44 gas spud at a firing rate of 22,000 BTU/hr. With total air at about 145% of that required for stoichiometric combustion and primary air at about 50%, the conventional residential production burner produced a $NO_x$ level of 98.59 ppm at 0% oxygen. For the prototype burner system of the present invention, with total air maintained at about 145% of that required for stoichiometric combustion and primary air at about 50%, $NO_x$ was reduced to 28.59 ppm at 0% oxygen. Further, CO emissions from the prototype burner and from the production burner under the aforestated test conditions were both 3 ppm on an air-free basis.

Although a preferred embodiment of the present invention has been described and illustrated, other changes will occur to those skilled in the art. It is therefore intended that the scope of the present invention is to be limited only by the scope of the appended claims.

What is claimed is:

1. A combustion system for use in a fuel-fired apparatus comprising:

a fuel-fired burner having an outlet section, said burner operative for generating a primary air and fuel mixture within said outlet section and generating a flame extending substantially downstream from a flame front formed downstream from said outlet section;

a burner insert including a catalyst body for oxidizing at least a portion of the fuel in the primary air and fuel mixture into intermediate combustion species, at least a substantial portion of said catalyst body being disposed upstream of the flame front; and a heat transfer member extending from said catalyst body in a downstream direction beyond said outlet section into the flame.

2. A fuel-fired apparatus comprising:

a fuel-fired burner having an outlet section, said burner operative for generating a primary air and fuel mixture within said outlet section and generating a flame extending in a downstream direction from said outlet section;

a heat transfer tube having an inlet, an outlet, and a gas flow conduit extending therebetween, the inlet of said heat transfer tube disposed in spaced opposing relation to the outlet of said burner whereby the flame extending from said burner passes into said heat transfer tube;

a burner insert including a catalyst body for oxidizing at least a portion of the fuel in the primary air and fuel mixture into intermediate combustion species, at least a substantial portion of said catalyst body being disposed upstream of the flame and at least a portion of said upstream portion disposed within said outlet section of said burner, and a heat transfer member extending from said catalyst body in a downstream direction beyond said outlet section.

3. A fuel-fired apparatus as recited in claim 1 further comprising an annular shroud extending in a generally axial direction about a region between said outlet section and the inlet of said heat transfer tube.

4. A fuel-fired apparatus as recited in claim 3 wherein said shroud extends about at least of portion of the outlet section of said burner housing said catalytic insert.

5. A fuel-fired apparatus system as recited in claim 2 wherein a portion of said catalyst body extends in a downstream direction beyond said outlet section.

6. A fuel-fired apparatus as recited in claim 5 further comprising an annular shroud extending in a generally axial direction about a region between said outlet section and the inlet of said heat transfer tube.

7. A fuel-fired apparatus as recited in claim 6 wherein said shroud extends about at least of portion of the outlet section of said burner housing said catalytic insert.

8. An in-shot burner for use in a fuel-fired apparatus comprising:

an axially elongated tube having an inlet end for receiving gaseous fuel and an outlet end, and operative for generating a primary air and fuel mixture therewithin and generating a flame extending from a flame front in a downstream direction beyond said outlet end of said tube; and a burner insert including a catalyst body for oxidizing at least a portion of the fuel in the primary air and fuel mixture into intermediate combustion species, at least a substantial portion of said catalyst body being disposed within said tube upstream of the flame front.

9. An in-shot burner as recited in claim 8 further comprising a heat transfer member extending from said catalyst body in a downstream direction beyond said outlet end of said tube.

10. An in-shot burner as recited in claim 8 wherein a portion of said catalyst body extends in a downstream direction beyond said outlet end of said tube.

* * * * *